US008833460B2

(12) United States Patent
Luppi et al.

(10) Patent No.: US 8,833,460 B2
(45) Date of Patent: Sep. 16, 2014

(54) OIL PIPE SUSPENSION DEVICE AND INSTALLATION METHOD

(75) Inventors: Ange Luppi, Nîmes (FR); Anthony Berger, Poulx (FR)

(73) Assignee: Technip France (FR)

( * ) Notice: Subject to any disclaimer, the term of this patent is extended or adjusted under 35 U.S.C. 154(b) by 2 days.

(21) Appl. No.: 13/384,274

(22) PCT Filed: Jul. 8, 2010

(86) PCT No.: PCT/FR2010/051447

§ 371 (c)(1),
(2), (4) Date: Mar. 15, 2012

(87) PCT Pub. No.: WO2011/007084

PCT Pub. Date: Jan. 20, 2011

(65) Prior Publication Data

US 2012/0168170 A1 Jul. 5, 2012

(30) Foreign Application Priority Data

Jul. 16, 2009 (FR) ..... 09 03496

(51) Int. Cl.
*E21B 17/01* (2006.01)
*E21B 43/01* (2006.01)

(52) U.S. Cl.
CPC ..... *E21B 17/015* (2013.01); *E21B 17/012* (2013.01); *E21B 43/0107* (2013.01)
USPC ..... 166/345; 166/350; 166/367; 405/224.2

(58) Field of Classification Search
CPC ..... E21B 17/012
USPC ..... 166/345, 338, 341–343, 350–352, 367, 166/380, 75.14; 405/171–173, 405/224.2–224.4; 441/3–5, 23–26
See application file for complete search history.

(56) References Cited

U.S. PATENT DOCUMENTS 3,641,602 A * 2/1972 Flory et al. ..... 441/5
3,894,567 A * 7/1975 Mott et al. ..... 141/388

(Continued)

FOREIGN PATENT DOCUMENTS

FR 2809136 11/2001
GB 2453168 A 4/2009
WO WO 2009/071762 A2 6/2009

OTHER PUBLICATIONS

International Search Report dated Oct. 10, 2010, issued in corresponding international application No. PCT/FR2010/051447.

(Continued)

*Primary Examiner* — Matthew Buck
(74) *Attorney, Agent, or Firm* — Ostrolenk Faber LLP

(57) ABSTRACT

A suspension device (14) for suspending an oil pipe on an underwater float (12) between a seabed and a sea surface and a method for installing such a device. The device (14) includes two hitching members (16,18) that respectively comprise a connection end (22, 22) and an attachment end (24, 24). The hitching members are respectively attached to the float (12) and to the coupling end (10) of the pipe by the fastener thereof while the connection ends (24, 24) are connected by connectors (20, 20). The connection end (22, 22) of each hitching member (16, 18) comprises two hooks (44, 46, 44, 46). The connectors include two independent links (20) for parallel adjustment so as to connect, two by two, the hooks (44, 46, 44', 46') of the two hitching members (16, 18).

11 Claims, 4 Drawing Sheets

(56) References Cited

U.S. PATENT DOCUMENTS

| | | | | |
|---|---|---|---|---|
| 4,082,050 | A * | 4/1978 | van Heijst | 114/53 |
| 4,130,076 | A * | 12/1978 | van Bilderbeek | 441/5 |
| 4,400,110 | A * | 8/1983 | Beynet et al. | 405/224.2 |
| 5,083,953 | A * | 1/1992 | Richardson | 441/6 |
| 6,082,391 | A * | 7/2000 | Thiebaud et al. | 137/236.1 |
| 6,321,844 | B1 * | 11/2001 | Thiebaud et al. | 166/345 |
| 6,595,725 | B1 * | 7/2003 | Shotbolt | 405/224.2 |
| 6,854,930 | B2 * | 2/2005 | Pionetti | 405/172 |
| 7,025,535 | B2 * | 4/2006 | Chiesa et al. | 405/169 |
| 7,073,593 | B2 * | 7/2006 | Hatton et al. | 166/367 |
| 7,197,999 | B2 * | 4/2007 | Murray | 114/264 |
| 7,367,398 | B2 * | 5/2008 | Chiesa et al. | 166/302 |
| 7,377,225 | B2 * | 5/2008 | Finn et al. | 114/264 |
| 7,404,695 | B2 * | 7/2008 | Chenin | 405/224.3 |
| 7,434,624 | B2 * | 10/2008 | Wilson | 166/368 |
| 7,934,560 | B2 * | 5/2011 | Roveri et al. | 166/345 |
| 7,946,790 | B2 * | 5/2011 | Casola et al. | 405/169 |
| 8,136,599 | B2 * | 3/2012 | Alliot | 166/350 |
| 2004/0218981 | A1 * | 11/2004 | Chenin | 405/169 |
| 2010/0209197 | A1 | 8/2010 | Luppi | |

OTHER PUBLICATIONS

Chiesa G. et al: "Bundle Hybrid Offset Riser (BHOR):An Advanced Solution for Improved Riser Tower Systems Installability and Operability in Deepwater West of Africa" OTC 16630, May 3, 2004, XP002570178 figures 1,13 the whole document.

Franciss R.: "Subsurface Buoy Configuration for Rigid Risers in Ultradeep Water" SPE 97376, Jun. 20, 2005, XP002570179 figure 6.

* cited by examiner

Fig.2A
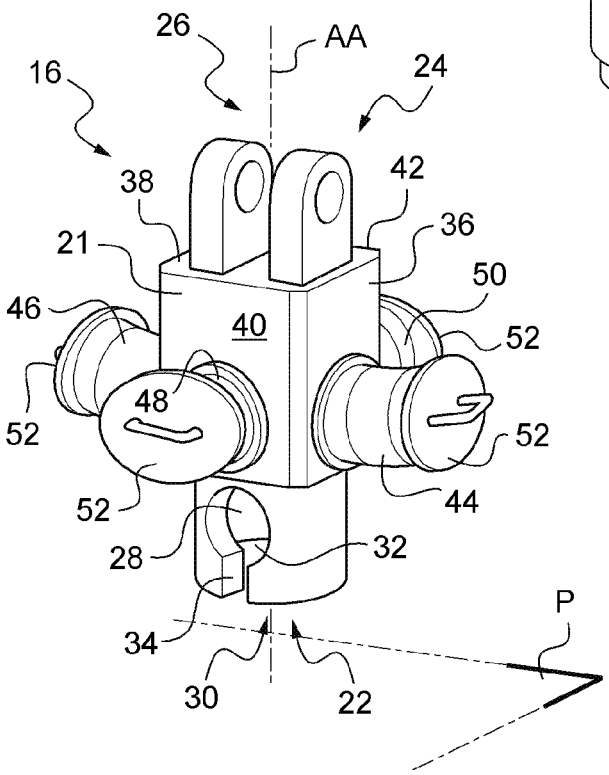
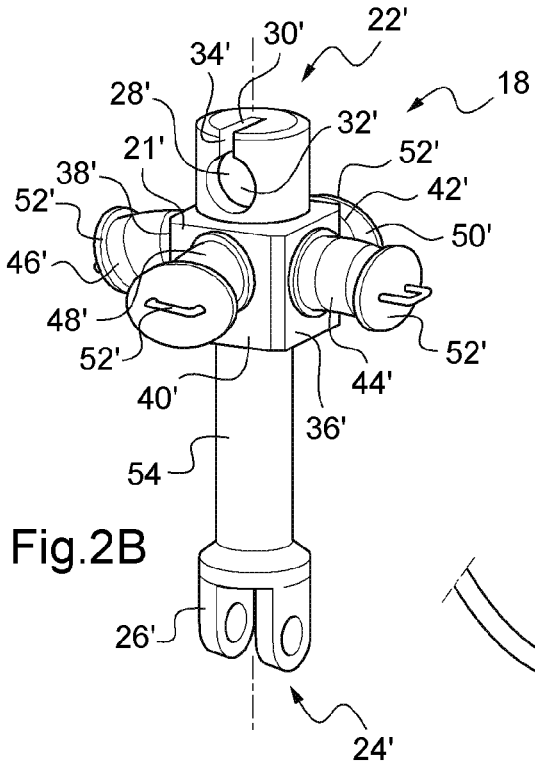
Fig.2B
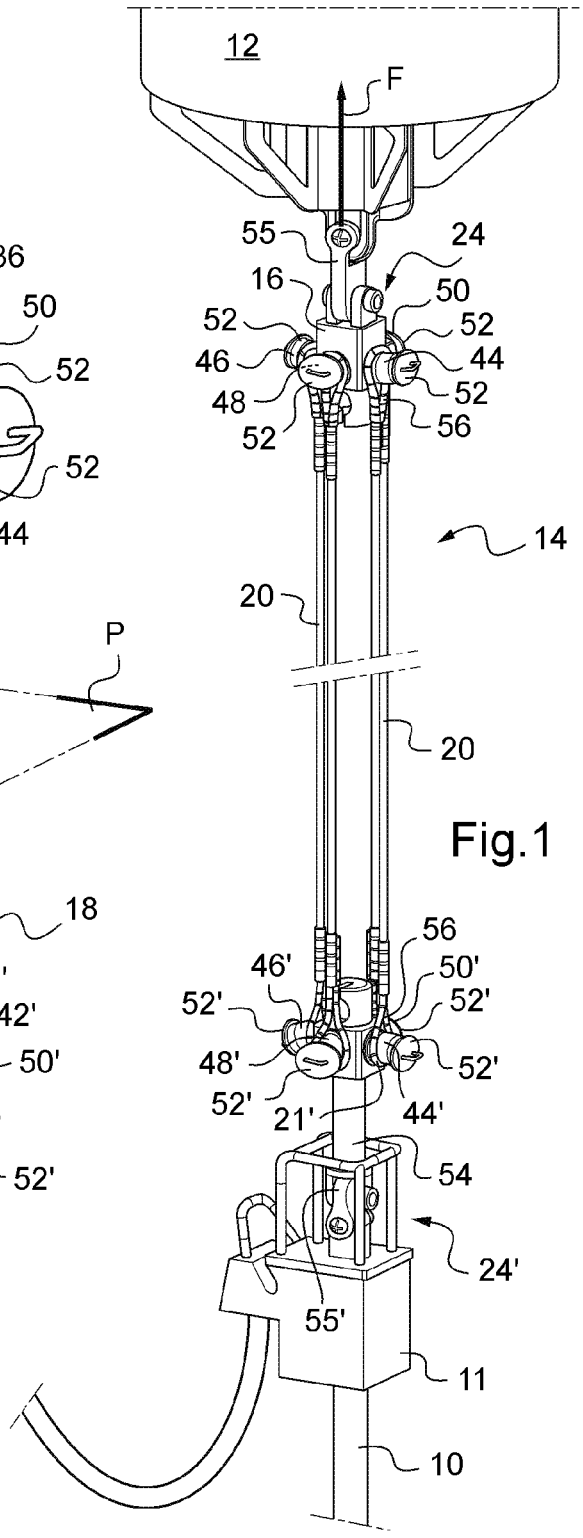
Fig.1

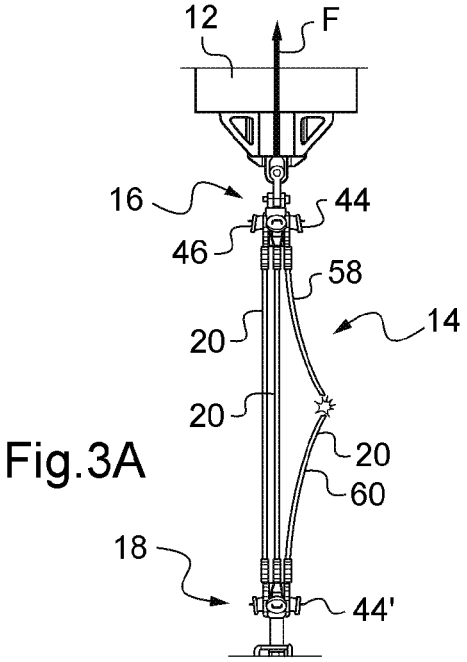
Fig.3A
Fig.3B
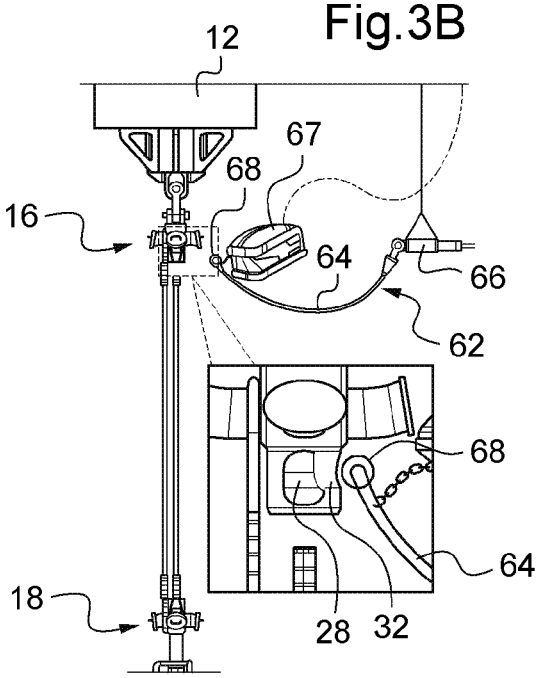
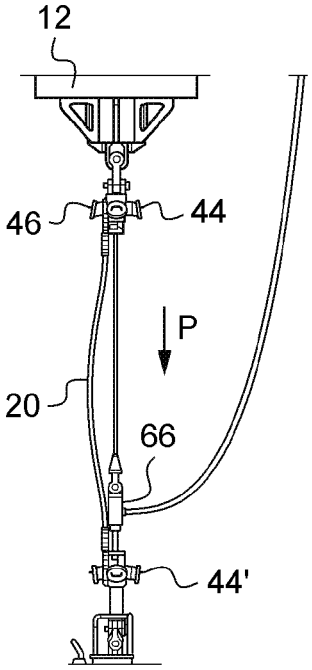
Fig.3C
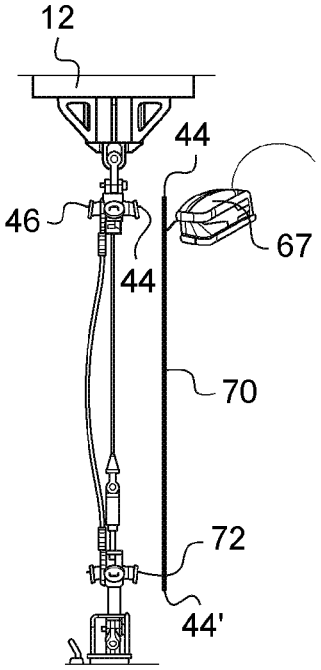
Fig.3D
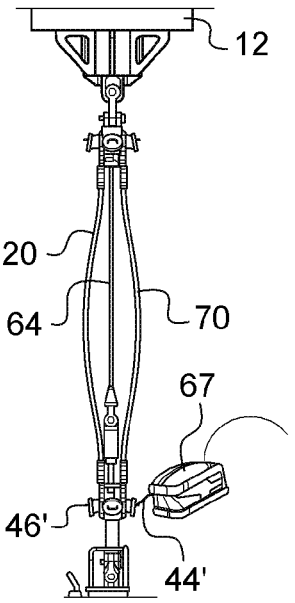
Fig.3E

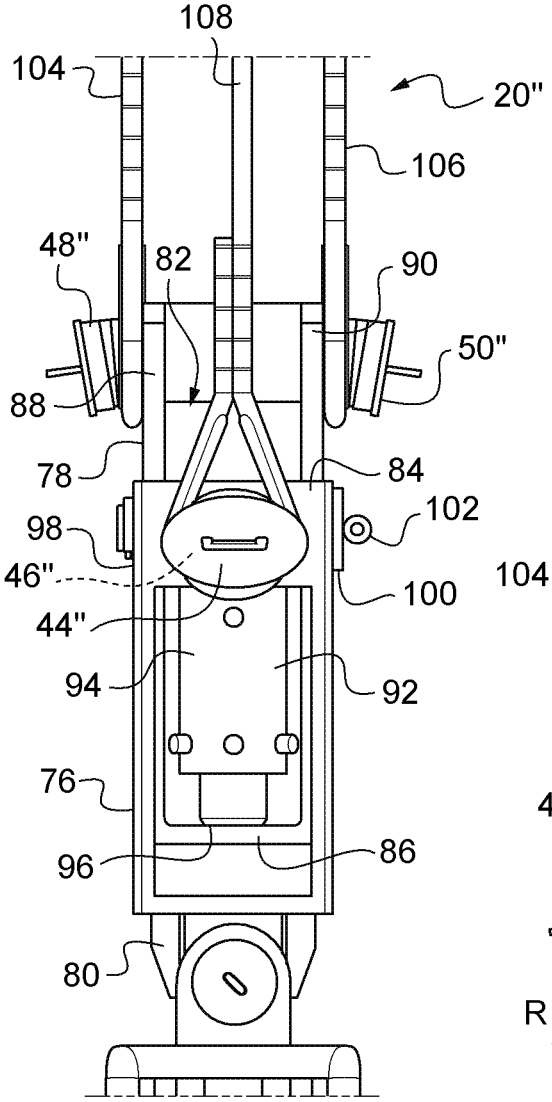
Fig.4A
Fig.4B
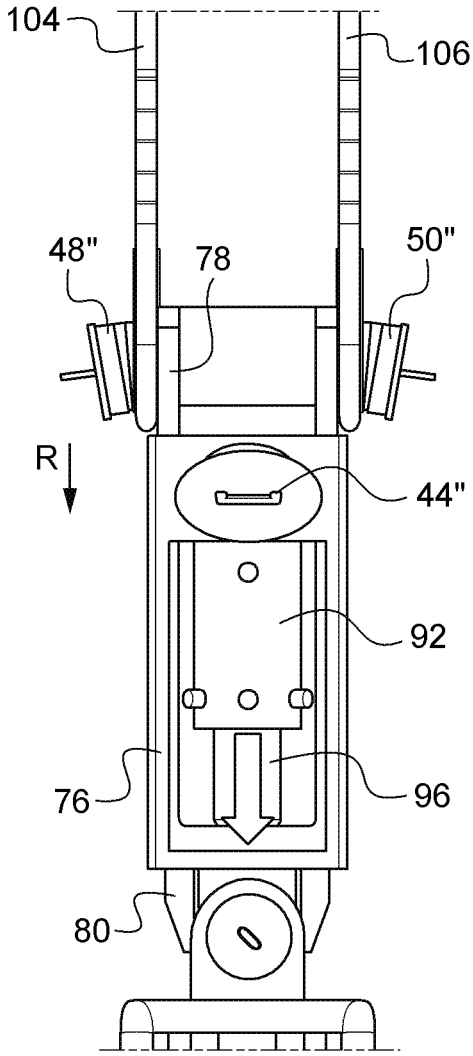

Fig.4C
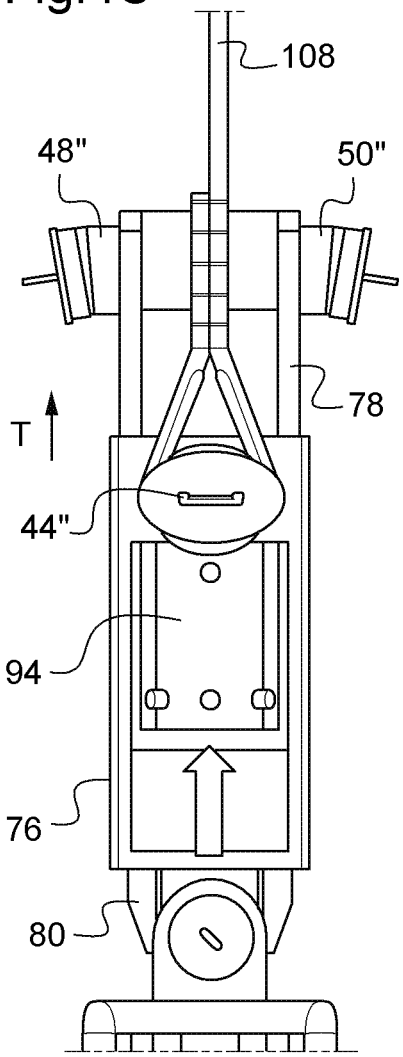
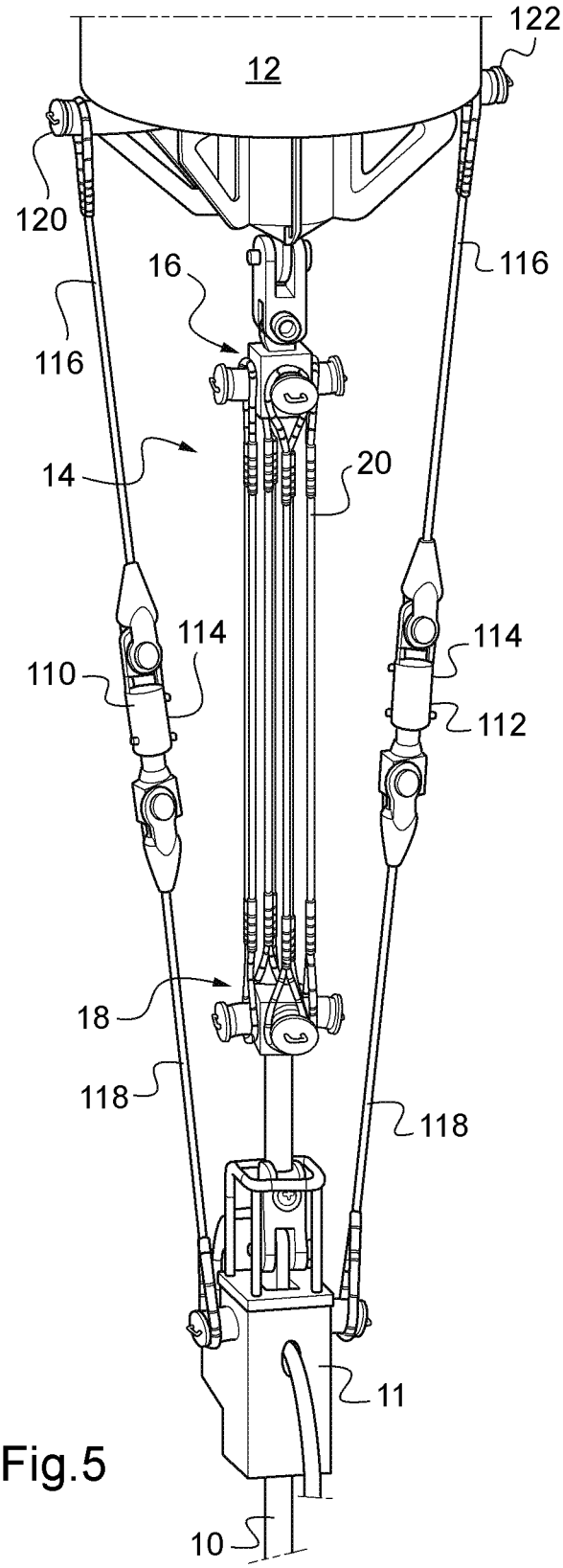
Fig.5

OIL PIPE SUSPENSION DEVICE AND INSTALLATION METHOD

CROSS-REFERENCE TO RELATED APPLICATIONS

The present application is a 35 U.S.C. §§371 national phase conversion of PCT/FR2010/051447, filed Jul. 8, 2010, which claims priority of French Application No. 0903496, filed Jul. 16, 2009, the contents of which are incorporated by reference herein. The PCT International Application was published in the French language.

The present invention relates to an oil pipe suspension device for suspending an oil pipe on a float in order to establish a connection between a seabed and a sea surface to route a hydrocarbon therein. The present invention also relates to a method of installing such a suspension device.

Thus, the field of the invention is installations for transferring fluids, in this instance hydrocarbons, between a seabed and a sea surface that are not shown here. These installations are commonly referred to as "riser towers". They comprise a tubular riser having a bottom end which is anchored to the seabed and having at the opposite end, a connection end that is connected to a float held a few tens of meters below the level of the sea surface. As a result, the float exerts traction on the riser to hold it vertically. A flexible pipe is then connected to the connection end and extends in a catenary from a surface installation. Accordingly, the hydrocarbon is routed from the seabed to the surface installation. The object of the invention relates precisely to the suspension device situated between the connection end of the riser and the float.

Known installations include devices for suspending oil pipes more commonly referred to as "risers". The pipe has a bottom end adapted to be anchored to the seabed, for example at a well head, and at the opposite end a connection end that is connected to a float situated below the sea surface. The length of the pipe is predefined so that the float is situated well below the sea surface, in an area that is not perturbed by the swell, so that it is able to exert a substantially constant traction in an upward direction. Moreover, the volume of the float is also determined to obtain a sufficient traction force. The connection end of the pipe is then connected to a flexible pipe that extends in a catenary toward a surface installation. The suspension device adapted to suspend the riser precisely on the float comprises two hitching members connected together by a flexible longitudinal element. These hitching members comprise a respective connection end. To the two connection ends are connected the respective two opposite ends of the flexible longitudinal element, and the other end opposite the connection end is provided with a fastener. The hitching members are then respectively attached to the float and to the connection end of the oil pipe via their fastener.

Reference may be made to the document FR 2 809 136, which discloses one such suspension device.

Because of the effect of sea currents, relative movement of the float and the riser induces localized stresses on the suspension device. The above prior art document precisely aims to prevent this concentration of stresses by providing a flexible longitudinal element the inertia of which varies along its length. However, fracture of this longitudinal element generated by repeated movements of the float and the riser causes the latter element to sink to the seabed. It is then difficult and above all costly to raise the riser. Furthermore, it is equally difficult to predict imminent fracture of this longitudinal element in order to be able to replace it.

Thus a problem that arises and that the present invention aims to solve is to provide a suspension device enabling easy inspection of its condition in such a manner as to be able to intervene and to replace it before fracture occurs.

SUMMARY OF THE INVENTION

With the aim of solving this problem, and in accordance with a first object, the present invention proposes an oil pipe suspension device for suspending a riser on a submarine float between a seabed and a sea surface, said riser having a connection end and at the opposite end a bottom end, said bottom end being adapted to be anchored to said seabed, while said connection end is connected to said float to retain said connection end in the vicinity of said sea surface, said suspension device comprising two hitching members and flexible link means, said hitching members comprising a respective connection end and at the opposite end an end provided with a fastener, said two hitching members being respectively attached to said float and to said connection end of said pipe by their fastener, while said connection ends of said two hitching members are connected together by said flexible link means. According to the invention said connection end of each hitching member includes two hooks that extend radially away from each other and said connection means comprise two flexible links independent of each other adapted to be fitted substantially parallel to connect two by two the respective hooks of said two hitching members.

Thus one feature of the invention is the use of two flexible links independent of each other, adapted to absorb traction forces of the float on the connection end of the pipe in order that it may be suspended. As a result, if one of the flexible links deteriorates, or in an extreme situation fractures, it is easy to determine visually the condition of the suspension device. Moreover, thanks to the use of the hooks on the hitching members, it is easier to substitute a new flexible link in good condition for the defective flexible link.

In one particularly advantageous embodiment of the invention, said connection end of each hitching member further includes at least two additional hooks that extend radially and said connection means comprise two additional flexible links independent of each other adapted to be fitted substantially parallel to connect two by two the respective additional hooks of said two hitching members. As a result, the connection means comprise four flexible links independent of each other and thus, if one of the links is damaged, the traction forces of the float on the riser are absorbed by the other three links. Consequently, the risk of deterioration of the other three links is lower, pending replacement of the defective flexible link, as each takes only one third of the additional traction forces. If there are only two connections, as envisaged hereinabove, they must each be sufficiently strong to take half of the additional traction forces in the event of fracture of one of the two.

In a particularly advantageous variant, at least one of said hitching members includes two elements sliding axially one in the other, one of said sliding elements including said two hooks, while the other of said sliding elements includes said two additional hooks in such a manner as to be able to modify the relative tension of said two independent flexible links and said two independent additional flexible links. In fact, and as explained in more detail in the remainder of the description, by driving the sliding elements one relative to the other the choice may be made to relax two of the links, and in particular the one that is defective, while the other two take the entire load of the traction forces. As a result, it is easier to replace the defective link.

According to another preferred variant, said connection end of each hitching member includes a mooring element in which the end of a sling is adapted to be engaged and, as explained hereinafter, it is possible to pull on the sling to move the hitching members toward each other.

Each hook advantageously has a substantially cylindrical barrel terminated by a free end. It extends substantially perpendicularly to the axis of the hitching member intersecting its two ends. This cylindrical barrel has at the end opposite its free end a fixing end fastened to the hitching member. As explained hereinafter, the flexible link is thus installed around the cylindrical barrel and against the hitching member. Said barrel is preferably curved substantially toward said corresponding fastener, precisely to retain the flexible link against the hitching member.

Furthermore, each independent flexible link advantageously includes a cable having a loop at each of its ends, said loop being adapted to be engaged in said hooks. Thus when the links are taut, in a direction substantially perpendicular to the barrels of the hooks, the loop remains trapped therein.

In accordance with another object, the present invention proposes a method of installing cables of said suspension device as described above, said method comprising the following steps: at least one cable is provided having a loop at each of its ends, said hitching members are moved toward each other a distance substantially less than the length of said at least one cable, the loops of said at least one cable are engaged around respective corresponding hooks of said hitching members, and said hitching members are then released in such a manner as to transfer at least part of the traction force of said float to said connection end via said at least one cable.

Accordingly, thanks to the suspension device of the invention, it is easy to install the riser and the float and, moreover, it is even easier to carry out maintenance if one of the cables is defective.

According to a particularly advantageous variant, said elements described above sliding axially one in the other are driven in translation to move said hitching members toward each other. It is thereafter easier to replace defective cables.

According to another variant, the mooring elements of said hitching members as described above are connected together by a sling and winch means for moving them toward each other. The advantages of this variant are explained in more detail hereinafter.

Other features and advantages of the invention will emerge on reading the following description of particular embodiments of the invention, given by way of nonlimiting example, with reference to the appended drawings, in which:

BRIEF DESCRIPTION OF THE DRAWINGS

FIG. 1 is a diagrammatic perspective view of a suspension device conforming to a first embodiment of the invention;

FIG. 2A is a diagrammatic detail perspective view of a first element shown in FIG. 1;

FIG. 2B is a diagrammatic detail perspective view of a second element shown in FIG. 1;

FIGS. 3A to 3E show diagrammatically a first method of installing another element of the suspension device shown in FIG. 1;

FIGS. 4A to 4C show diagrammatically a second method of installing the other element of the suspension device shown in FIG. 1; and FIG. 5 shows diagrammatically a third method of installing the other element of the suspension device shown in FIG. 1.

FIG. 1 shows a connection end 10 of a riser surmounted by a beam 11 and connected to a float 12 by a suspension device 14. The latter device includes an upper hitching member 16 connected to the float 12 and a lower hitching member 18 connected to the connection end 10 of the riser. These two hitching members 16, 18 are connected to each other by four identical and parallel cables 20. As a result, the float 12 exerts a substantially vertical traction oriented toward the sea surface on the connection end 10 of the riser via the taut cables 20.

The hitching members 16, 18 are described in more detail with reference to FIGS. 2A and 2B. The upper hitching member 16 includes an upper body 21 having an upper connection end 22 and at the opposite end an attachable upper end 24. It extends longitudinally along an axis of symmetry AA over a length in the range one meter to two meters, for example 1.60 m. The attachable upper end 24 has an upper yoke 26 forming a fastener and adapted to receive a fixing rod substantially perpendicular to the axis of symmetry AA to trap a shackle fastened to the float 12. As for the upper connection end 22, it is terminated by an upper tubular cavity 28 having an upper axial orifice 30 and an upper radial orifice 32. The upper radial orifice 32 has a greater diameter than the upper axial orifice 30 and an upper axial slot 34 provides communication between the two orifices. The upper connection end 22 thus forms a mooring element.

The upper connection end 22 of the upper body 21 of the upper hitching member 16 has four upper faces disposed as opposite pairs 36, 38 and 40, 42 from which respectively extend radially four substantially cylindrical upper barrels 44, 46 and 48, 50 forming hooks. They define a median plane substantially perpendicular to the axis of symmetry AA of the upper hitching member 16 and are successively oriented at substantially 90° to each other.

These substantially cylindrical upper barrels 44, 46; 48, 50 have a length in the range 1.5 times to twice their diameter, for example, which is in the range 0.2 m to 0.8 m, and they are substantially curved towards the attachable upper end 24 precisely to form a hook. Moreover, they have a free end 52 having a retaining enlargement the function of which is explained in more detail in the remainder of the description.

FIG. 2B coincides with FIG. 2A with the result that the lower hitching member 18 is fitted coaxially with the upper hitching member 16 and in a symmetrical manner with respect to a horizontal plane P. Accordingly, the lower hitching member 18 includes elements identical to and in corresponding relationship to the upper hitching member 16, and these elements then have in FIG. 2B the same references "primed" ('). Thus the lower hitching member 18 includes a lower body 21' having a lower connection end 22' and at the opposite end an attachable lower end 24'. It also extends longitudinally along an axis of symmetry AB coinciding with the axis of symmetry AA of the upper hitching member 16, and over a length in the range two meters to four meters, for example 3.50 meters, because it is further equipped with an axial extender rod 54 situated between the body 21' and a lower yoke 26'. The lower yoke 26' also forming a fastener is adapted to receive another fixing rod substantially perpendicular to the axis of symmetry AB to trap another one fastened to the connection end 10. The lower connection end 22' terminates at a lower tubular cavity 28' having a lower axial orifice 30' and a lower radial orifice 32'. The lower radial orifice 32' has a greater diameter than the lower axial orifice 30' and a lower axial slot 34' establishes communication between the two orifices. The lower tubular cavity 28' of the lower connection end 22' also forms a mooring element and the two mooring elements, that of the lower connection end 22' and that of the upper connection end 22, extend facing each other and at a distance from each other and are adapted to be connected to each other by traction means described hereinafter.

The lower body 21' of the lower hitching member 18 has, in the same fashion, four lower faces disposed in opposite pairs 36', 38' and 40', 42' from which respectively extend radially four substantially cylindrical lower barrels 44', 46' and 48', 50' forming hooks. These lower barrels 44', 46'; 48', 50' have a length in the range 1.5 times to twice their diameter and are substantially curved, the opposite way to the upper barrels, toward the attachable lower end 24 and precisely to form hooks. Just like the upper barrels 44, 46; 48, 50, they have an enlarged lower free end 52'.

Referring again to FIG. 1, in which the coaxially oriented and facing hitching members 16, 18 are connected together by the aforementioned four cables 20 in a mode of connection described hereinafter. The upper hitching member 16 is fastened to the float 12 by means of an upper shackle 55 that is fastened to the float 12 and that extends into the upper yoke 26 to be trapped therein by means of a nut-and-bolt system. Thus the upper hitching member 16 is articulated to the float 12 on which it is mounted. At the opposite end, the lower hitching member 18 is fastened to the connection end 10 by means of a lower shackle 55' that is attached to the beam 11. Thanks to the axial extender rod 54, the lower body 21' of the lower hitching member 18 is at a distance from the beam 11 to reduce congestion around the latter and to favor a better approach. Furthermore, the shackle 55' is trapped inside the lower yoke 26' by means of another nut-and-bolt system to form an articulation.

Regarding the mode of connection, the cables 20 are of identical lengths and each has at its ends a deformable loop 56 the maximum diameter of which is greater than the diameter of the upper cylindrical barrels 44, 46; 48, 50 and the lower cylindrical barrels 44', 46'; 48', 50'. Thus the cables 20 fit between the respective two hitching members 18, 16 in such a fashion that the two deformable loops 56 of each of the cables 20 are respectively engaged around the lower barrels 44', 46'; 48', 50' and the upper barrels 44, 46; 48, 50 in corresponding relationship. As a result, a cable portion of each of the loops bears on a cylindrical barrel at the junction with its corresponding face.

The deformable loops 56 constituted by the end of the cables curved on itself and bound are relatively rigid. And when the cylindrical barrel is engaged inside them and the axial traction of the float 12 and the connection end 10 is exerted on the cables, the deformable loops 56 are trapped on the hitching member 16, 18 because the cylindrical barrels 44', 46'; 48', 50' and 44, 46; 48, 50 are respectively substantially curved in the direction opposite the traction that is exerted on the loop. Moreover, the enlarged free end 52, 52' forms a stop that prevents the deformable loop 56 escaping from the corresponding cylindrical barrel when the cables are taut.

Accordingly, the overall traction force F exerted by the float 12 is divided between the four cables 20 and therefore divided into four substantially equal fractions. The advantage of such a configuration lies notably in the secure connection between the float 12 and the connection end 10. In fact, if one of the cables 20 fractures, the other three are able to take the traction force. Moreover, thanks to the embodiment of the invention described hereinabove, the deterioration of the suspension device 14 may be seen and, additionally, may be remedied by a method of replacement or installation described next with reference to FIGS. 3A to 3E.

FIG. 3A shows the suspension device 14 as shown in FIG. 1 with one of the cables 20 fractured into two parts, an upper part 58 still fastened to the upper hitching member 16 and a lower part 60 fastened to the lower hitching member 18. Thus the overall traction force F is now distributed between the remaining three cables 20. The replacement method of the invention consists firstly in drawing the hitching members 16, 18 toward each other to loosen the remaining cables 20 and to remove the broken cable parts 58, 60 to replace them with a cable in good condition the same length as the others.

To do this, it is necessary to overcome the upward traction forces exerted by the float 12 and to draw it a relatively short distance, of the order of one meter, toward the seabed. Accordingly, in the embodiment shown in FIGS. 3A to 3E, the upper hitching member 16 and the lower hitching member 18 are connected together at their upper connection end 22 and lower connection end 22' by means of a hydraulic jack 62 comprising a sling 64 connected to actuator means 66. These actuator means 66 are adapted to exert retraction forces of the order of 6000 Newtons, for example. As FIG. 3B shows, a remote-controlled submarine robot 67 is used to engage an enlarged free end 68 of the sling 64 inside the upper tubular cavity 28 by engaging it through the upper radial orifice 32. The remote-controlled submarine robot 67 is then used to draw the sling 64 toward the lower hitching member 18, engaging it through the upper axial slot 34 and then the upper axial orifice 30 to trap the enlarged free end 68 inside the upper tubular cavity 28. To this end, the enlarged free end 68 is obviously wider than the upper axial orifice 30 or of greater diameter if it is circular. The end of the sling 64 is thus moored to the upper hitching member 16. The actuator means 66 with the sling 64 are then caused to descend and the actuator means 66 are hitched onto the lower connection end 22'. To this end, the actuator means 66 also have an enlarged free end adapted to be engaged inside the lower tubular cavity 28' to be trapped therein. Retraction of the actuator means 66 is then commanded, as FIG. 3C shows, which has the effect of drawing the float 12 toward the seabed in the direction of the arrow P. The stroke of the actuator means 66 is 0.5 m, for example, which relaxes the other cables 20. The submarine robot 67 is then used to remove the broken cable parts 58, 60. Then, as shown in FIG. 3D, the submarine robot 67 is used again to fit a new cable 70. This new cable 70, identical to the other cable 20, has a loop 72 at each of its ends. The submarine robot 67 is then used to engage these loops 72 around the upper cylindrical barrel 44 of the upper hitching member 16 and the corresponding lower cylindrical barrel 44' of the lower hitching member 18, respectively. As shown in FIG. 3E, this installation is naturally effected without having to exert traction on the new cable 70 because the two hitching members 16, 18 have been moved significantly toward each other.

As a result, the cylindrical barrels 44, 44' are easily engaged in the corresponding loops 72 without excessive deformation of the latter loops despite the enlarged free ends 52, 52' forming stops. Because, in fact, no tension is being exerted on the cable, the loops retain their original shape in which they define a substantially maximum open area.

The submarine robot 67 is naturally then used to release the actuator means 66 and as relaxation proceeds the three cables 20 and the new cable 70 therefore take the tension exerted by the float 12.

In an embodiment of the invention that is not shown, the actuator means are constituted of a winch in which the sling 64 is engaged.

Refer now to FIGS. 4A to 4C, which show a second installation method. To this end, the lower hitching member 18 of the first embodiment includes two elements mobile relative to each other. The elements shown in these figures and having functions analogous to those of those shown in FIGS. 1 and 2B carry identical references "double-primed" (").

Accordingly, in this second embodiment, the lower hitching member includes a symmetrically cylindrical first element 76 with a straight generatrix and a second element 78 constituted of a U-shaped part installed so that it slides inside the first element 76. The first element 76 has a fixing end 80 articulated to the connection end, not shown, of the riser on which it is mounted and at the opposite end an open end 82 through which the second element 78 is engaged. The first element 76 also has an upper facial edge 84 from which projects one of the lower cylindrical barrels 44". In symmetrical manner, and to the rear of the plane of the figure, one of the other lower cylindrical barrels 46" extends from an opposite upper edge.

The second element 78 has a bottom wall 86 and two parallel flanges 88, 90 adapted to extend outside the symmetrically cylindrical first element 76. Moreover, the lower hitching member includes inside the two elements 76, 78 a hydraulic piston-and-cylinder actuator 92 including a body 94 fastened to the first element 76 at the level of its opening 82 and, at the opposite end, an actuator rod 96 fastened to the bottom wall 86 of the second element 78. Moreover, the first element 76 has two opposite lateral edges 98, 100 pierced by two respective coaxial orifices and the two flanges 88, 90 have, in the same fashion, two coaxial bores, so that the second element 78 may be retained and immobilized in translation inside the first element 76 by means of a locking rod 102 engaged in the coaxial orifices and also in the bores.

Moreover, the second element 78 supports at the free end of its two flanges 88, 90 the other two lower and opposite cylindrical drums 48", 50". It is seen that, in a vertical direction, these other two lower cylindrical barrels 48", 50" are spaced from one of said lower cylindrical barrels 44" and one of the other lower cylindrical barrels 46" and in an opposite direction to the fixing end 80 of the first element 76. Also, given that the upper hitching member, not shown here, is identical to that shown in FIG. 2A, the cables 20" are of two different lengths. Thus the cables 104, 106 of a first pair of cables are installed on the other two opposite lower cylindrical barrels 48", 50" in the same manner as the cables 20 installed on the lower hitching member 18 shown in FIG. 1. On the other hand, the cables of a second pair of cables longer than the cables 104, 106 of the first pair, only one of which 108 is seen in FIG. 4A, are respectively installed on one of said lower cylindrical barrels 44" and one of the other lower cylindrical barrels 46".

As a result, if one of the cables of the second pair of cables 108 is fractured, to replace it, first the locking rod 102 is withdrawn, then the piston-and-cylinder actuator 92 is commanded so as to extend it, as shown in FIG. 4B, in order to engage the second element 78 further inside the first element 76 in the direction of the arrow R. Consequently, the traction exerted on the cables 104, 106 causes the upper hitching member, not shown here, to move toward the lower hitching member and more particularly relative to one said lower cylindrical barrels 44" and one of the other lower cylindrical barrels 46". As a result, as in the embodiment shown in FIGS. 3D and 3E, one of the cables of the second pair of cables 108 may be replaced.

The piston-and-cylinder actuator 92 may then be commanded again to retract the actuation rod 96 in such a manner that the new cable is tensioned and the coaxial bores and orifices of the two elements 76, 78 may be realigned to be able to reengage the locking rod 102.

On the other hand, if it is one of the cables of the first pair of cables 104, 106 that is damaged and must be replaced, the piston-and-cylinder actuator 92 is no longer commanded to extend it but is retracted, its rod 96 being accommodated entirely within its body 94. In this configuration, the float and the connection end of the riser remain stationary with respect to each other. It is in fact the other two opposite lower cylindrical barrels 48", 50" respectively installed on the two flanges 88, 90 of the second element 78 that are moved in the direction of the arrow T toward the upper hitching member. Thus the load is taken entirely by the cables of the second pair of cables 108 and either of the cables of the first pair of cables 104, 106 may then be replaced.

According to a third embodiment, shown in FIG. 5, the float 12 and the connection end 10 of the riser that is located there are connected directly together and driven toward each other. There are shown in this figure all the elements shown in FIG. 1 and additionally two identical hydraulic jacks 110, 112 installed on either side of the suspension device 14. These two hydraulic jacks 110, 112 have a central piston-and-cylinder actuator 114 and two half-slings 116, 118. Two half-slings 116 of the two jacks 110, 112 are moored to the float 12 on two diametrically opposite radial eyebolts 120, 122, respectively, while the other two half-slings 118 are respectively moored to the opposite two sides of the beam 11. Thus if the two central piston-and-cylinder actuators 114 of the two hydraulic jacks 110, 112 are commanded simultaneously to retract them, the upper hitching member 16 and the lower hitching member 18 are moved toward each other in an analogous fashion to that of the first embodiment shown in FIGS. 3A to 3E. The cables 20 are then replaced in the same manner.

The invention claimed is:

1. An oil pipe suspension device for suspending a riser on a submarine float between a seabed and a sea surface, the riser having a first connection end configured for connection to the suspension device and a first opposite bottom end configured for being anchored to the seabed while the first connection end is connected to the suspension device, the suspension device comprising:

first and second spaced apart hitching members, the first hitching member having a second connection end configured for articulable connection to the submarine float, and the second hitching member having a respective second connection end configured for articulable connection to the riser;

each hitching member including at least two hooks extending radially out from the hitching member; and a first flexible link supported by and extending between a first one of the hooks of the first hitching member and a first one of the hooks of the second hitching member;

a second flexible link supported by and extending between a second one of the hooks of the first hitching member and a second one of the hooks of the second hitching member;

wherein the first and the second flexible links are spaced apart from each other, and wherein the links are disengageable from the hooks.

2. A suspension device according to claim 1, wherein each hitching member further includes at least two additional hooks that also extend radially out from the hitching member; and further comprising two additional flexible links, each independent of the other links, and each additional link being supported by and extending between one additional hook of the first hitching member and one additional hook of the second hitching member.

3. A suspension device according to claim 2, wherein at least one of the hitching members is comprised of two elements which are slidable axially, one element in the other element, one of the sliding elements includes the two hooks and the other of the sliding elements includes the two additional hooks, the sliding elements being slidable relatively to modify the relative tension of the two flexible links and the two additional flexible links.

4. A suspension device according to claim 1, wherein at least one of the hitching members includes a mooring element in which an end of a sling is to be engaged.

5. A suspension device according to claim 1, wherein each hook has a substantially cylindrical barrel terminated by a free end.

6. A suspension device according to claim 5, wherein the barrel has a shape curved substantially away from a corresponding flexible link.

7. A suspension device according to claim 1, wherein each flexible link includes a cable having ends and a loop at each of its ends, the loop being configured to be engaged with the hooks.

8. A method of installing cables of a suspension device according to claim 7, the method comprising the following steps:

moving the hitching members toward each other a distance substantially less than the length of the cables;

engaging each loop of each cable around a respective hook of a respective hitching member; and then releasing the hitching members in such a manner as to transfer at least part of the traction force of the float to the first connection end via the cables.

9. An installation method according to claim 8, wherein at least one of the hitching members is comprised of two elements which are slidable axially, one element in the other element, one of the sliding elements including the two hooks and the other of the sliding elements including two additional hooks, the sliding elements being slidable relatively to modify the relative tension of the two flexible links and two additional flexible links supported by the two additional hooks; and the method further comprising driving the elements that slide axially one in the other in translation to move the hitching members toward each other.

10. An installation method according to claim 8, wherein each hitching member includes a mooring element in which an end of a sling is to be engaged for connecting the mooring elements of the hitching members by the sling and a winch.

11. A suspension device according to claim 1, wherein the first and second flexible links are independent of each other and are configured to be fitted substantially parallel to each other.

* * * * *